US010087566B2

(12) United States Patent
Carr et al.

(10) Patent No.: US 10,087,566 B2
(45) Date of Patent: Oct. 2, 2018

(54) LAUNDRY TREATING APPLIANCE WITH INDEXING TANG CLUTCH

(71) Applicant: WHIRLPOOL CORPORATION, Benton Harbor, MI (US)

(72) Inventors: David Carr, Saint Joseph, MI (US); Eric Farrington, Stevensville, MI (US); David Goshgarian, Benton Harbor, MI (US); Vetrivel Kanagaraj, Saint Joseph, MI (US); Narendra Kapure, Pune (IN); Abhijeet Nalawade, Pune (IN); Kartik Vastrad, Pune (IN); Bret Wamhoff, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 177 days.

(21) Appl. No.: 15/065,184

(22) Filed: Mar. 9, 2016

(65) Prior Publication Data

US 2017/0260679 A1 Sep. 14, 2017

(51) Int. Cl.

| | |
|---|---|
| ***D06F 37/40*** | (2006.01) |
| ***D06F 39/02*** | (2006.01) |
| ***D06F 39/04*** | (2006.01) |
| ***D06F 39/00*** | (2006.01) |
| ***D06F 33/02*** | (2006.01) |
| ***D06F 37/30*** | (2006.01) |
| ***D06F 39/08*** | (2006.01) |

(52) U.S. Cl.

CPC ..... *D06F 37/40* (2013.01); *D06F 37/30* (2013.01); *D06F 39/003* (2013.01); *D06F 39/028* (2013.01); *D06F 39/045* (2013.01); *D06F 39/085* (2013.01); *D06F 39/088* (2013.01)

(58) Field of Classification Search

CPC ..... D06F 37/30; D06F 37/40; D06F 39/003; D06F 39/028; D06F 39/045; D06F 39/085; D06F 39/088

See application file for complete search history.

(56) References Cited

U.S. PATENT DOCUMENTS

| | | | | |
|---|---|---|---|---|
| 3,209,877 A * | 10/1965 | Jordan | F16D 43/26 192/139 |
| 4,387,580 A | 6/1983 | Kennedy et al. | |
| 4,803,855 A | 2/1989 | Kennedy | |
| 4,890,465 A | 1/1990 | Burk et al. | |
| 5,000,016 A * | 3/1991 | Burk | D06F 37/40 68/23.7 |
| 5,926,887 A * | 7/1999 | Thompson | D06F 37/40 192/12 BA |
| 7,703,307 B2 * | 4/2010 | Kim | D06F 37/40 68/133 |

(Continued)

*Primary Examiner* — Joseph L. Perrin

(57) ABSTRACT

A laundry treating appliance having a tub defining an interior, a basket located within the interior and rotatably mounted within the tub, a clothes mover rotatably mounted within the basket, a motor drivingly coupled to the clothes mover to selectively oscillate or rotate the clothes mover, and a loss motion device having a clutch configured to move among a set of indexed positions in response to rotation of the clothes mover, with the loss motion device being configured to rotationally couple the clothes mover and the basket after the clutch moves through the set of indexed positions.

19 Claims, 10 Drawing Sheets

(56) References Cited

U.S. PATENT DOCUMENTS

| | | | | |
|---|---|---|---|---|
| 2005/0011233 | A1* | 1/2005 | Vaidhyanathan | D06F 37/145 68/23.7 |
| 2009/0145173 | A1 | 6/2009 | Seeger et al. | |
| 2012/0304704 | A1* | 12/2012 | Ponnaganti | D06F 37/40 68/140 |
| 2013/0199247 | A1 | 8/2013 | Lee et al. | |

* cited by examiner

LAUNDRY TREATING APPLIANCE WITH INDEXING TANG CLUTCH

BACKGROUND OF THE INVENTION

Laundry treating appliances, such as a washing machine, are known to have a configuration where a rotating drum may be provided and defines a treating chamber in which laundry may be placed for treatment. The laundry treating appliance may have a controller that implements a number of user-selectable, pre-programmed cycles of operation. Hot water, cold water, or a mixture thereof along with various treating chemistries may be supplied to the treating chamber in accordance with the cycle of operation.

Washing machines having a drive system between the motor and clothes mover and basket require a clutch mechanism so that the washing machine will be able to operate in an agitate mode wherein the agitator is oscillated while the basket is held stationary and in an extraction mode wherein the agitator and basket are spun together. The drive system can have several configurations such as direct or belt drive. Conventional washing machines can incorporate a spring clutch or a spline clutch with a solenoid to actuate the clutch, moving the clutch member vertically on the motor shaft to selectively engage or disengage a connection with the basket. Such spline clutches and solenoids are fairly expensive mechanisms.

SUMMARY OF THE INVENTION

In one aspect, illustrative embodiments in accordance with the present disclosure relate to a laundry treating appliance including a tub defining an interior, a basket located within the interior and rotatably mounted within the tub, a clothes mover rotatably mounted within the basket, a motor drivingly coupled to the clothes mover to selectively oscillate or rotate the clothes mover, and a loss motion device having a clutch configured to move among a set of indexed positions in response to rotation of the clothes mover, wherein the loss motion device is configured to rotationally couple the clothes mover and the basket after the clutch moves through the set of indexed positions.

In another aspect, illustrative embodiments in accordance with the present disclosure relate to a laundry treating appliance including a tub defining an interior, a basket located within the interior and rotatably mounted within the tub, a clothes mover rotatably mounted within the basket, a motor drivingly coupled to the clothes mover to selectively oscillate or rotate the clothes mover, and a tang clutch assembly having a rotatable tang clutch mounted to one of the clothes mover and the basket, wherein the tang clutch assembly is moveable among indexed positions, and wherein the tang clutch assembly moves from one indexed position to a next indexed position in response to rotation of the clothes mover.

In yet another aspect, illustrative embodiments in accordance with the present disclosure relate to a laundry treating appliance including a tub defining an interior, a basket located within the interior and rotatably mounted within the tub, a clothes mover rotatably mounted within the basket, a motor drivingly coupled to the clothes mover to selectively oscillate or rotate the clothes mover, and a planetary drive mechanism having a sun gear operably connected with the motor, a plurality of planet gears, a planet carrier connected to the plurality of planet gears and operably connected with the clothes mover, and a ring gear operably connected with the basket, and a tang clutch mechanism operably coupled to the planetary drive mechanism and configured to permit oscillatory motion of the clothes mover and rotary motion of the clothes mover and the basket; wherein the tang clutch mechanism permits oscillatory motion of the clothes mover by an amount greater than 360 degrees.

DESCRIPTION OF EMBODIMENTS OF THE INVENTION

Figure 1:
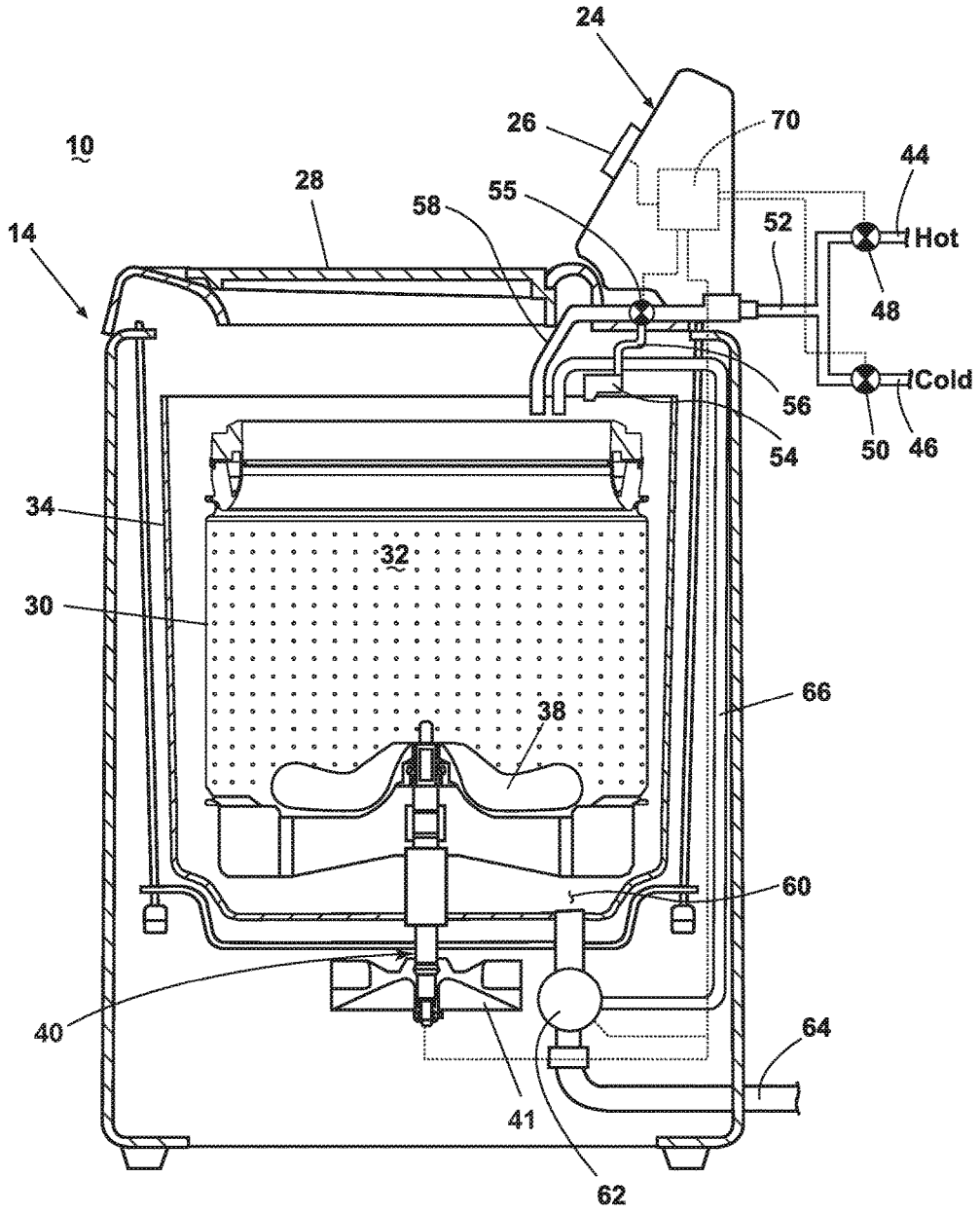
FIG. 1 is a schematic cross-sectional view of a laundry treating appliance according to one embodiment of the invention.

Illustrative washing machines in accordance with the present disclosure include a rotatable clothes mover and a rotatable basket. Clothes movers generally oscillate, or rotate back and forth in accordance with a stroke angle, to provide agitation to a laundry load during washing operations. Clothes movers and rotatable baskets generally spin together during spin cycle operations. To enable both of these functionalities—oscillation by the clothes mover and joint spinning by the clothes mover and basket—through a common drive system, washing machines may include a clutch mechanism. Such a clutch mechanism leaves the clothes mover and the rotatable basket uncoupled during oscillation of the clothes mover, but then couples the clothes mover and rotatable basket during spin cycle operations so that they spin together.

Clutch mechanisms may allow the clothes mover to oscillate up to a certain stroke angle while the clothes mover and the rotatable basket are uncoupled. Once the clothes mover rotates beyond that angle, clutch mechanisms may engage, resulting in rotational coupling of the clothes mover and the rotatable basket. However, typical clutch mechanisms are limited in that they may only allow 180-360 degrees of oscillatory rotation by the clothes mover—beyond this amount of rotation, the clothes mover and the rotatable basket will couple and spin together. This limits the available stroke angle for the clothes mover during agitation.

Clutch mechanisms in accordance with the present disclosure enable oscillation by the clothes mover of 360 degrees or more. This is achieved by providing the clutch mechanisms with an indexing functionality. After the clothes mover rotates by a certain angle, the clutch mechanism does not simply engage, but rather proceeds from one indexed position to a next indexed position. Continued rotation by the clothes mover may cause the clutch mechanism to continue traversing through successive indexed positions. Only when the clutch mechanism occupies a final index position will continued rotation by the clothes mover cause engagement by the clutch, coupling the clothes mover and the rotatable basket. By varying the number of indexed positions provided on the clutch mechanism, one can vary the oscillatory stroke angle available to the clothes mover before the clutch mechanism engages.

Illustrative embodiments in accordance with the present disclosure include clutch mechanisms that have different configurations and different numbers of indexed positions. For example, an L-shaped clutch described below may include two indexed positions, enabling up to a 720 degree stroke angle (i.e., two full rotations by the clothes mover). A clover-shaped clutch described below may include four indexed positions, enabling up to a 1080 degree stroke angle (i.e., three full rotations by the clothes mover). Other types of clutch mechanisms that provide different numbers of indexed positions are in accordance with the present disclosure, as will be explained below.

FIG. 1 illustrates a laundry treating appliance in the form of a washing machine 10 according to one embodiment of the invention. The laundry treating appliance may be any machine that treats articles such as clothing or fabrics. Non-limiting examples of the laundry treating appliance may include a vertical washing machine; a combination washing machine and dryer; and a refreshing/revitalizing machine. The washing machine 10 described herein shares many features of a traditional automatic washing machine, which will not be described in detail except as necessary for a complete understanding of the invention.

Washing machines are typically categorized as either a vertical axis washing machine or a horizontal axis washing machine. As used herein, the "vertical axis" washing machine refers to a washing machine having a rotatable drum, perforate or imperforate, that holds fabric items and a clothes mover, such as an agitator, impeller, nutator, and the like within the drum. The clothes mover moves within the drum to impart mechanical energy directly to the clothes or indirectly through wash liquid in the drum. The clothes mover may typically be moved in a reciprocating rotational movement. In some vertical axis washing machines, the drum rotates about a vertical axis generally perpendicular to a surface that supports the washing machine. However, the rotational axis need not be vertical. The drum may rotate about an axis inclined relative to the vertical axis. As used herein, the "horizontal axis" washing machine refers to a washing machine having a rotatable drum, perforated or imperforate, that holds fabric items and washes the fabric items by the fabric items rubbing against one another as the drum rotates. In some horizontal axis washing machines, the drum rotates about a horizontal axis generally parallel to a surface that supports the washing machine. However, the rotational axis need not be horizontal. The drum may rotate about an axis inclined relative to the horizontal axis. In horizontal axis washing machines, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles. The illustrated exemplary washing machine of FIG. 1 is a vertical axis washing machine.

As illustrated in FIG. 1, the washing machine 10 may include a housing 14, which may be a cabinet or a frame to which decorative panels may or may not be mounted. A user interface 24 may be included on the housing 14 and may have one or more knobs, switches, displays, and the like for communicating with the user, such as to receive input and provide output. A door or lid 28 may be operably coupled with the housing 14 and may be selectively moveable between opened and closed positions to close an opening in a top wall of the housing 14, which provides access to the interior of the housing 14.

A rotatable basket 30 having an open top may be disposed within the interior of the housing 14 and may define a treating chamber 32 for treating laundry. A tub 34 may also be positioned within the housing 14 and may define an interior within which the basket 30 may be positioned. The basket 30 can be rotatably mounted within the tub 34 and may include a plurality of perforations (not shown), such that liquid may flow between the tub 34 and the basket 30 through the perforations. While the illustrated washing machine 10 includes both the tub 34 and the basket 30, with the basket 30 defining the treating chamber 32, it is within the scope of the invention for the laundry treating appliance to include only one receptacle, with the receptacle defining the laundry treatment chamber for receiving the load to be treated.

A clothes mover 38 may be rotatably mounted within the basket 30 to impart mechanical agitation to a load of laundry placed in the basket 30. The basket 30 and the clothes mover 38 may be driven by a drive system 40 that includes a motor 41 operably coupled with the basket 30 and clothes mover 38. A loss motion device or clutch 100, 200, 300 (FIGS. 3, 5A, 6A) can be included in the drive system 40 and can selectively operably couple the motor 41 with either the basket 30 and/or the clothes mover 38. The clothes mover 38 can be oscillated or rotated about its axis of rotation during a cycle of operation in order to produce load motion effective to wash the load contained within the treating chamber 32. The motor 41 can rotate the basket 30 at various speeds in either rotational direction about an axis of rotation.

A liquid supply system can be provided to liquid, such as water or a combination of water and one or more wash aids, such as detergent, into the treating chamber 32. The liquid supply system can include a water supply configured to supply hot or cold water. The water supply can include a hot water inlet 44 and a cold water inlet 46, a valve assembly, which can include a hot water valve 48, a cold water valve 50, and a diverter valve 55, and various conduits 52, 56, 58. The valves 48, 50 are selectively openable to provide water, such as from a household water supply (not shown) to the conduit 52. The valves 48, 50 can be opened individually or together to provide a mix of hot and cold water at a selected temperature. While the valves 48, 50 and conduit 52 are illustrated exteriorly of the housing 14, it may be understood that these components can be internal to the housing 14.

As illustrated, a detergent dispenser 54 can be fluidly coupled with the conduit 52 through a diverter valve 55 and a first water conduit 56. The detergent dispenser 54 can include means for supplying or mixing detergent to or with water from the first water conduit 56 and can supply such treating liquid to the tub 34. It has been contemplated that water from the first water conduit 56 can also be supplied to the tub 34 through the detergent dispenser 54 without the addition of a detergent. A second water conduit, illustrated as a separate water inlet 58, can also be fluidly coupled with the conduit 52 through the diverter valve 55 such that water can be supplied directly to the treating chamber through the open top of the basket 30. Additionally, the liquid supply system can differ from the configuration shown, such as by inclusion of other valves, conduits, wash aid dispensers, heaters, sensors, such as water level sensors and temperature sensors, and the like, to control the flow of treating liquid through the washing machine 10 and for the introduction of more than one type of detergent/wash aid.

A liquid recirculation system can be provided for recirculating liquid from the tub 34 into the treating chamber 32. More specifically, a sump 60 can be located in the bottom of the tub 34 and the liquid recirculation system can be configured to recirculate treating liquid from the sump 60 onto the top of a laundry load located in the treating chamber 32. A pump 62 can be housed below the tub 34 and can have an inlet fluidly coupled with the sump 60 and an outlet configured to fluidly couple to either or both a household drain 64 or a recirculation conduit 66. In this configuration, the pump 62 can be used to drain or recirculate wash water in the sump 60. As illustrated, the recirculation conduit 66 can be fluidly coupled with the treating chamber 32 such that it supplies liquid into the open top of the basket 30. The liquid recirculation system can include other types of recirculation systems.

Figure 2:
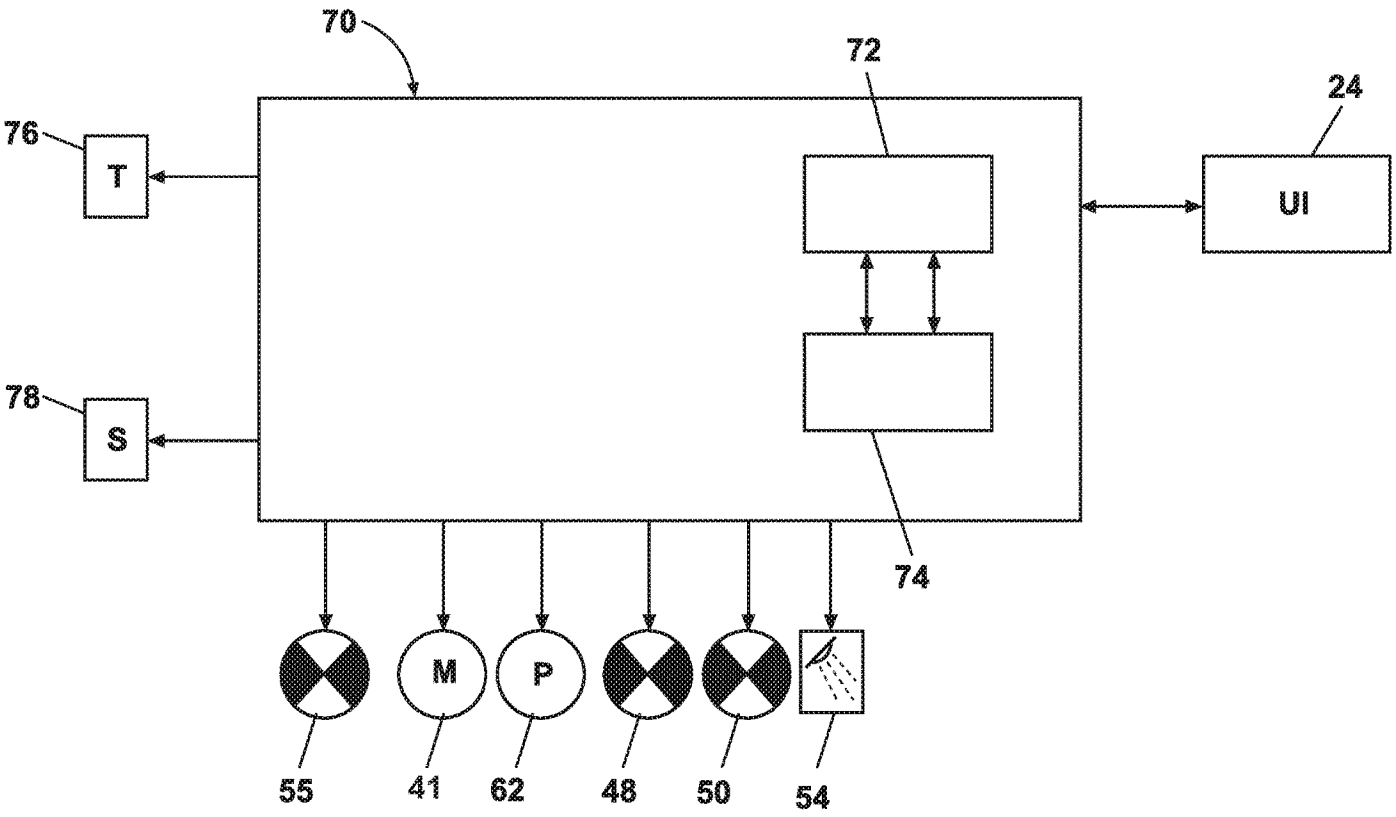
FIG. 2 is a schematic representation of a controller for controlling the operation of one or more components of the laundry treating appliance of FIG. 1.

The washing machine 10 can further include a controller 70 coupled with various working components of the washing machine 10 to control the operation of the working components. As illustrated in FIG. 2, the controller 70 can be provided with a memory 72 and a central processing unit (CPU) 74. The memory 72 can be used for storing the control software that can be executed by the CPU 74 in completing a cycle of operation using the washing machine 10 and any additional software. The memory 72 can also be used to store information, such as a database or table, and to store data received from the one or more components of the washing machine 10 that can be communicably coupled with the controller 70.

The controller 70 can be operably coupled with one or more components of the washing machine 10 for communicating with and/or controlling the operation of the components to complete a cycle of operation. For example, the controller 70 can be coupled with the hot water valve 48, the cold water valve 50, diverter valve 55, and the detergent dispenser 54 for controlling the temperature and flow rate of treating liquid into the treating chamber 32; the pump 62 for controlling the amount of treating liquid in the treating chamber 32 or sump 60; drive system 40 including a motor 41 for controlling the direction and speed of rotation of the basket 30 and/or the clothes mover 38; and the user interface 24 for receiving user selected inputs and communicating information to the user. The controller 70 can also receive input from a temperature sensor 76, such as a thermistor, which can detect the temperature of the treating liquid in the treating chamber 32 and/or the temperature of the treating liquid being supplied to the treating chamber 32. The controller 70 can also receive input from various additional sensors 78, which are known in the art and not shown for simplicity. Non-limiting examples of additional sensors 78 that can be communicably coupled with the controller 70 include: a weight sensor, and a motor torque sensor.

Figure 3:
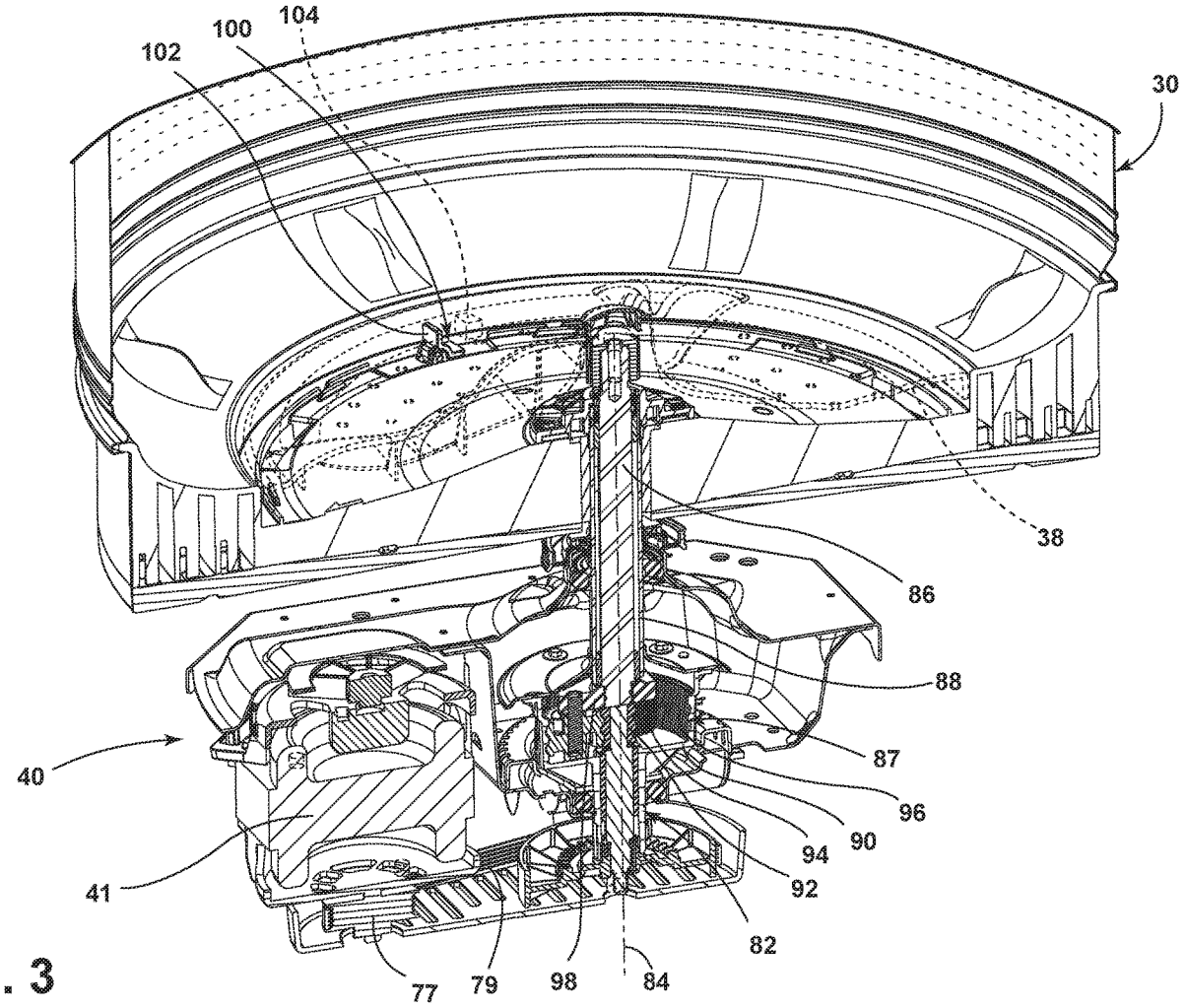
FIG. 3 is a perspective view of a portion of a basket, impeller, drive system, and loss motion device that can be included in the laundry treating appliance of FIG. 1 in accordance with the present disclosure.

The basket 30, clothes mover 38, and drive system 40 are shown in greater detail in FIG. 3. The motor 41 can be drivingly coupled to the clothes mover 38 to selectively oscillate or rotate the clothes mover 38. More specifically, the motor 41 can include an output 77 that is connected through a belt system 79 to an output drive shaft 82 configured to rotate about an axis of rotation 84. Alternatively, the motor 41 could be directly connected to the output drive shaft 82. The output drive shaft 82 can further include a first drive shaft 86 configured to couple with and rotate the clothes mover 38 and a second drive shaft 88 configured to couple with and rotate the basket 30. As shown, the first drive shaft 86 can be concentric to, and positioned within the interior diameter of the second drive shaft 88. Each drive shaft 86, 88 can be configured to rotate, for example, independently of the other, in unison with the other, or at dissimilar rotational speeds or directions from the other.

The drive system 40 can further include a planetary drive mechanism having a planetary gearbox 87. The planetary gearbox 87 can include a gearbox housing 90, a sun gear 92, a set of planet gears 94, and an outer concentric ring gear 96, wherein the gears 92, 94, 96 are positioned within the housing 90. The sun gear 92 is rotationally coupled with the drive shaft 82, and includes gears configured to mesh with and rotate the set of planet gears 94 positioned concentrically about the sun gear 92 and within the outer ring gear 96. Each of the planet gears 94 is coupled with a planet carrier 98 such that the rotation of the planet gears 94 about the ring gear 96, as driven by the sun gear 92, rotates the planet carrier 98 about the axis of rotation 84. The planet carrier 98 can be further coupled with the first drive shaft 86 to rotate the clothes mover 38. The ring gear 96 is operably connected with the basket 30 via the second drive shaft 88, which can also be known as a spin tube.

The planetary gearbox 87 can be configured in any suitable manner including that it can be configured in a speed-reducing configuration, such that the output rotational speed of the first drive shaft 86 is less than the rotational speed of the drive shaft 82. The planetary gearbox 87, sun gear 92, planet gears 94, ring gear 96, and the like, can be configured or selected to provide a desired rotational speed-reducing ratio based on the rotational speed of the drive shaft 82, the desired rotational speed of the clothes mover 38, or the desired agitation of the washing machine 10 or the cycle of operation. Alternatively, embodiments of the disclosure are envisioned wherein the motor 41 does not include a gearbox, and the drive shaft 82 is directly coupled with at least one of the first or second drive shafts 86, 88.

The motor 41 operates as controlled by the controller 70. The rotational speed of the drive shaft 82 can be reduced by the planetary gearbox 87 and delivered to the clothes mover 38 to rotate the clothes mover 38, which ultimately provides movement to the laundry load contained within the laundry treating chamber 32. When the washer is operating in the agitate mode, the motor 41 is operated in a reversing fashion which causes the drive shaft 82 to oscillate, thus driving the sun gear 92 in alternating opposite directions. The clothes mover 38 is therefore oscillated through its connection with the planet gears 94. The wash basket 30 can be held stationary while the clothes mover 38 is oscillated, for example by means of a brake mechanism (not shown).

A loss motion device or clutch mechanism 100 is included and allows for switching the washing machine 10 between a mode in which the clothes mover 38 oscillates relative to the basket 30 and a mode in which the clothes mover 38 and the basket 30 rotate together. In exemplary implementations, the clothes mover 38 may oscillate during a wash cycle to provide agitation, and the clothes mover 38 and the basket 30 may spin together during a spin cycle.

A tang clutch 102 can form a portion of the clutch mechanism 100 and is pivotally mounted to a lower portion of the basket 30. In the illustrated example, the rotatable tang clutch 102 is L-shaped, although this need not be the case. More specifically in the illustrated example, a first leg 106 and a second leg 108 of the tang clutch 102 form the L-shape. The tang clutch 102 is pivotal among indexed positions, including a first indexed position (FIG. 4A) and a second indexed position (FIG. 4C) to selectively couple and uncouple, respectively, the clothes mover 38 and the basket 30.

A clutch pin 104 is also included in the clutch mechanism 100 and can be operably coupled to the clothes mover 38 (FIG. 3). The clutch pin 104 has been schematically illustrated as a block but it will be understood that it can be shaped in any suitable manner. Further, it can be mounted to the clothes mover 38 or integrally formed therewith. It will be understood that for clarity the clothes mover 38 has not been illustrated in FIGS. 4A-4C.

The clutch pin 104 is configured for selective engagement with the tang clutch 102. More specifically, the clutch pin 104 moves the tang clutch 102 between the first and second indexed positions as the clothes mover 38 rotates in the counter-clockwise direction. Once the tang clutch 102 occupies the second indexed position, continued rotation of the clothes mover 38 by approximately 360 degrees causes the clutch pin 104 to engage with the tang clutch 102 (FIG. 4C). Once the clutch pin 104 and the tang clutch 102 are so engaged, the clothes mover 38 and the basket 30 are rotationally coupled, in that continued rotation of the clothes mover 38 in the counter-clockwise direction will cause both the clothes mover 38 and the basket 30 to rotate.

Figure 4A:
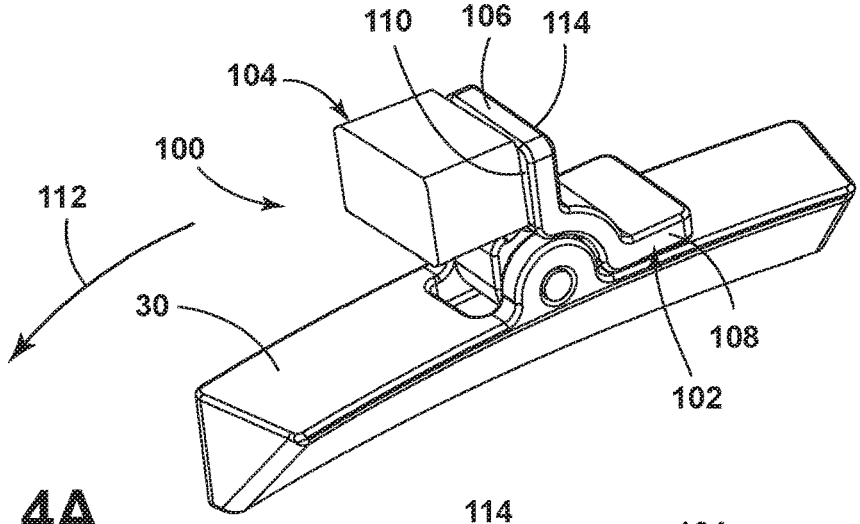
FIGS. 4A-4C illustrate a tang clutch that can be utilized in the loss motion device of FIG. 3.
Figure 4B:
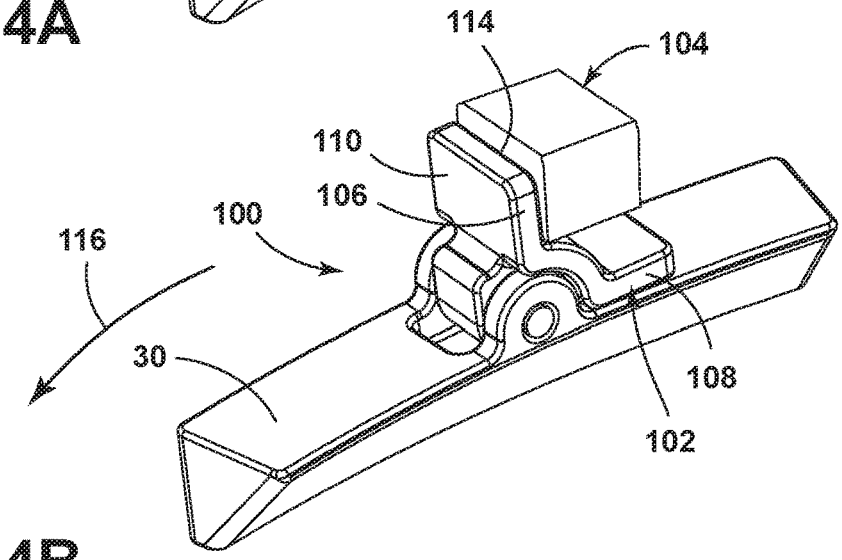
Figure 4C:
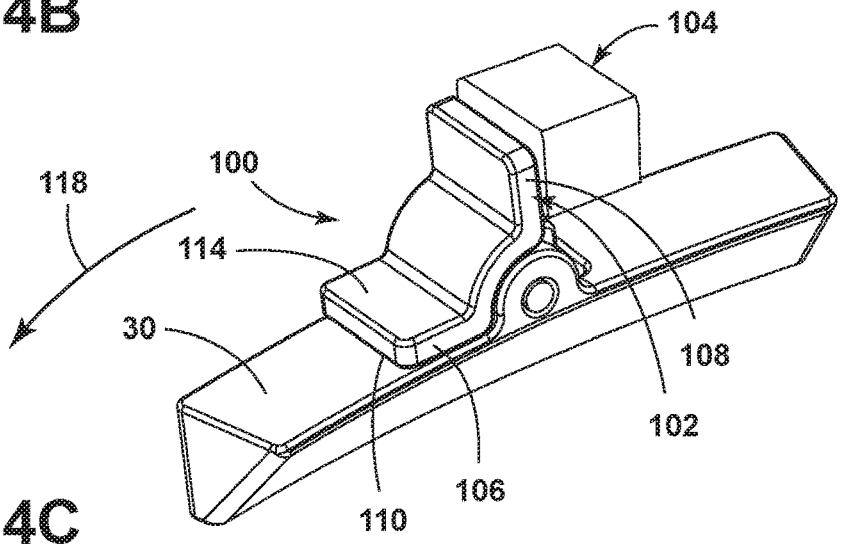

For example, in FIG. 4A, the tang clutch 114 occupies a first indexed position. As depicted, a first side 110 of the first leg 106 abuts the clutch pin 104. If the clothes mover 38 and the clutch pin 104, which moves therewith, are rotated in a counter-clockwise direction as illustrated by the arrow 112 then the clutch pin 104 moves away from the first side 110 of the first leg 106. When the clothes mover 38 has moved approximately 360 degrees it comes into contact with the second side 114 of the first leg 106 as illustrated in FIG. 4B. Continued rotational movement of the clothes mover 38 in the counter-clockwise direction, as illustrated by arrow 116, will pivot the tang clutch 102 to a second indexed position, such that the first leg 106 is down and the second leg 108 is up. Continued rotational movement of the clothes mover 38 of approximately 360 degrees in the counter-clockwise direction brings the clutch pin into contact with second leg 108 as illustrated in FIG. 4C. Any additional motion of the clothes mover 38 in the counter-clockwise direction, as illustrated by arrow 118, results in rotational coupling of the clothes mover 38 and the basket 30 such that they will rotate together.

Thus, the tang clutch 102 is pivotal between first and second indexed positions to selectively couple and uncouple, respectively, the clothes mover 38 and the basket 30. The movement of the tang clutch 102 between the first and second indexed positions occurs after the clothes mover 38 has completed a rotation. Rotational engagement between the clothes mover 38 and the basket 30 occurs after the clothes mover 38 has completed one additional rotation, enabling a spin operation.

Thus, this implementation enables the clothes mover 38 to have up to a 720 degrees stroke angle for oscillatory or rotational motion before the tang clutch 102 and the clutch pin 104 rotationally engage. This provides the benefit of a large range of motion for the clothes mover 38 during agitation. In exemplary implementations, in a wash phase or agitate phase, the clothes mover 38 is oscillated through an angle of approximately 170 degrees to 680 degrees during each stroke.

Oftentimes it is desirable to hold the basket 30 fixed relative to the tub 34 during the agitate mode and to do this the brake mechanism (not shown) is left in an operational condition. However, during the water extraction step or spin step, the basket 30 is spun with the clothes mover 38 and any brake mechanism can be released from frictional engagement with the basket 30.

The clutch mechanism 100 can also include a mechanism, such as but not limited to a ball spring plunger (not shown), to keep it locked into each individual indexed position. Further, it is contemplated that either the tang clutch 102 and/or the clutch pin 104 can include a sound deadening material (not shown) such that engagement will not be audibly noticeable.

The washing machine 10 can perform one or more manual or automatic treating cycles or cycle of operation. A common cycle of operation includes a wash phase, a rinse phase, and a spin extraction phase. Other phases for cycles of operation include, but are not limited to, intermediate extraction phases, such as between the wash and rinse phases, and a pre-wash phase preceding the wash phase, and some cycles of operation include only a select one or more of these exemplary phases. Agitation may be employed during any of these phases, but is particularly suitable for the wash phase, as agitation may impart mechanical action on a laundry load that improves cleaning performance.

It will be understood that the tang clutch 102 can be mounted to the clothes mover 38 or the basket 30 and that the clutch pin 104 can be operably coupled to the other of the clothes mover 38 or the basket 30 and configured for selective engagement with the tang clutch 102. It will further be understood that the loss motion device can be formed in any suitable manner and included in various locations within the washing machine 10 so long as the loss motion device is moveable between a set of indexed positions and rotationally couples the clothes mover 38 and the basket 30 after the clothes mover 38 has rotated through an appropriate number of rotations. Thus, the pin 104 engages the tang clutch 102 to move the tang clutch 102 through indexed positions with each full rotation of the clothes mover 38 until a position of engagement is reached and further rotary motion of the clothes mover 38 will cause engagement of the tang clutch 102 and the clutch pin 104, resulting in rotary motion of the perforated basket 30.

It should also be understood that rotation of the clothes mover may also move the tang clutch 102 to previous indexed positions. For example, if the tang clutch 114 and the clutch pin 104 occupy the positions depicted in FIG. 4C and the clothes mover 38 rotates in a clockwise direction by an amount greater than 360 degrees, the tang clutch 114 may move from the second indexed position back to the first indexed position (FIG. 4B).

Figure 5A:
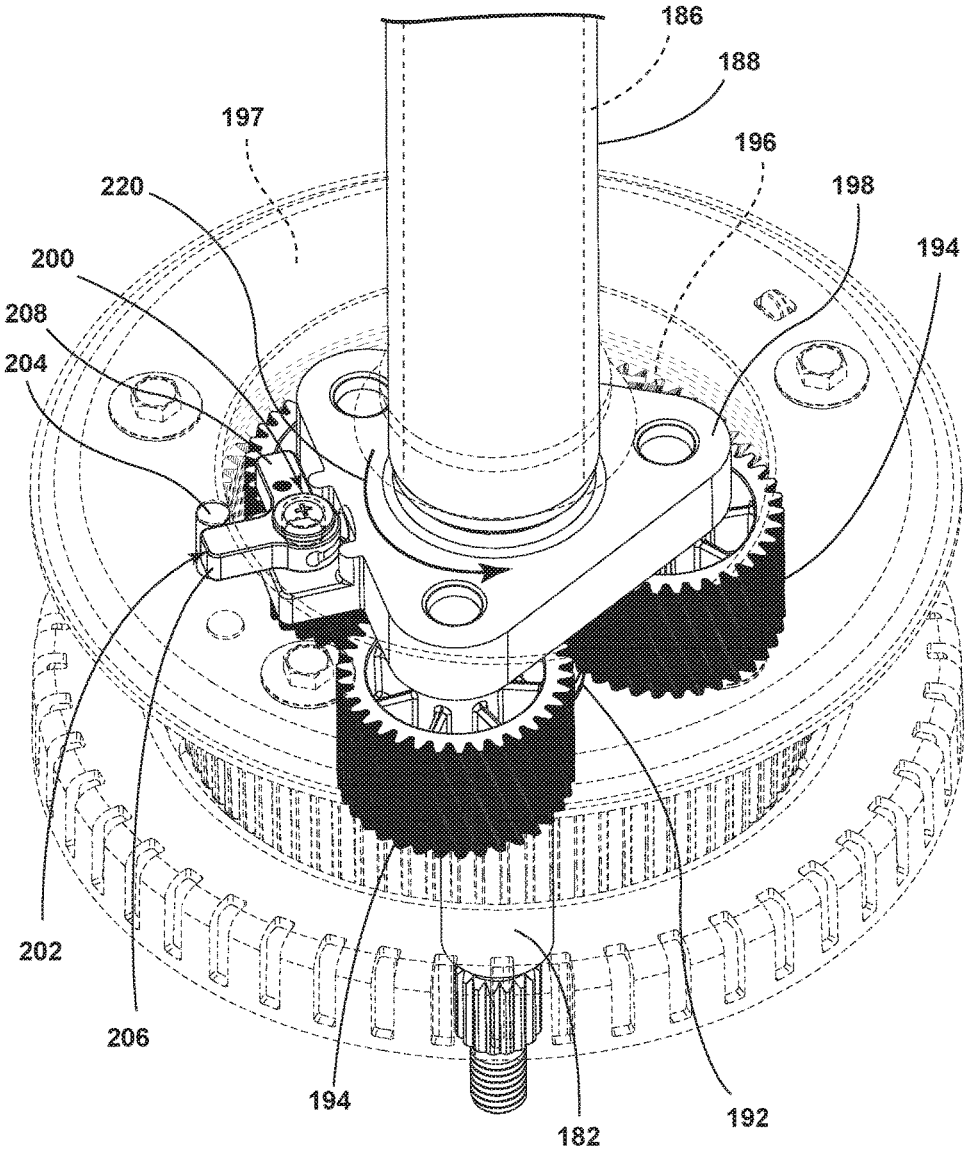
FIGS. 5A-5C illustrate a portion of an alternative drive system and loss motion device that can be included in the laundry treating appliance of FIG. 1 in accordance with the present disclosure.

FIG. 5A illustrates an alternative clutch mechanism 200. The second embodiment is similar to the first embodiment; therefore, like parts will be identified with like numerals increased by 100, with it being understood that the description of the like parts of the first embodiment applies to the second embodiment, unless otherwise noted.

Like the previous embodiment, the drive mechanism 140 includes a planetary drive mechanism having a gear box (not shown) housing a sun gear 192 operably coupled with the motor 41 via an output drive shaft 182. A set of planet gears 194 and an outer concentric ring gear 196 are also more clearly illustrated. Each of the planet gears 194 is coupled with a planet carrier 198 such that the rotation of the planet gears 194 about the ring gear 196, as driven by the sun gear 192, rotates the planet carrier 198. The planet carrier 198 is coupled with the first drive shaft 186 to rotate the clothes mover 38. A plate 197 is illustrated as connecting the ring gear 196 and the second drive shaft 188 and such plate 197 has been illustrated in phantom. Further, a clutch mechanism 200 is included to permit oscillatory motion of the clothes mover 38 and rotary motion of the clothes mover 38 and the basket 30 after the clothes mover 38 has rotated by an amount greater than 360 degrees.

One difference is that the clutch mechanism 200 is operably coupled to the planetary drive mechanism. More specifically, the tang clutch 202 is carried on the planet carrier 198 and pivotally mounted thereto. The tang clutch 202 is operably coupled to the planet carrier 198 and connected in this manner to move with the clothes mover 38. The clutch pin 204 is mounted on the gearbox housing 90 and connected to move with the basket 30. The clutch pin 204 is engageable with the tang clutch 202 at a predetermined angular position of the ring gear 196 relative to the planet carrier 198, enabling oscillatory motion of the clothes mover 38 by up to a 720 degree stroke angle before rotational coupling of the tang clutch 202 and the clutch pin 204. Thus, like the clutch mechanism 100, the clutch mechanism 200 is moveable between a set of indexed positions to selectively couple and uncouple the clothes mover 38 and the basket 30. The clutch mechanism 100 permits oscillatory motion of the clothes mover 38 by up to a 720 degree stroke angle.

Figure 5B:
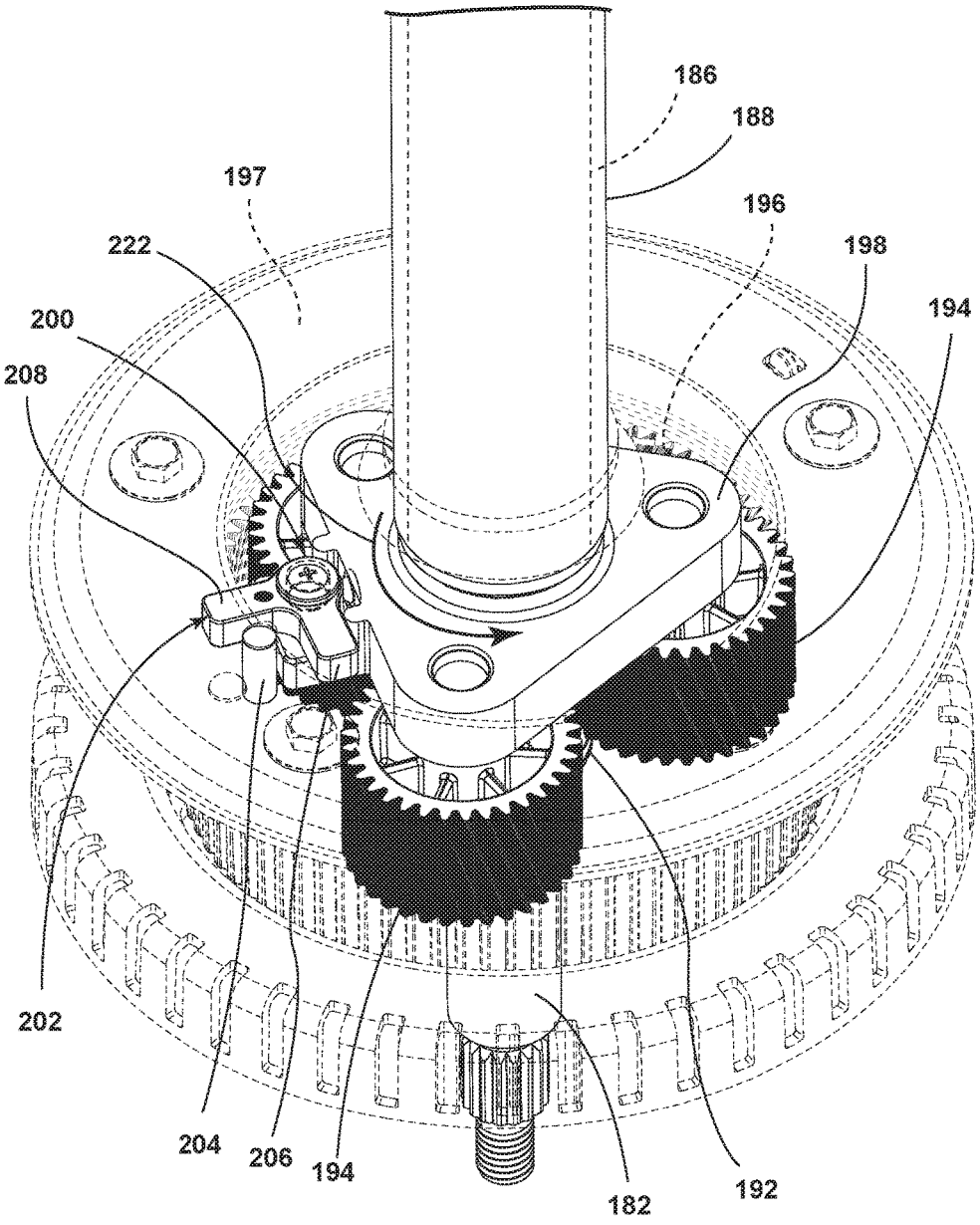
Figure 5C:
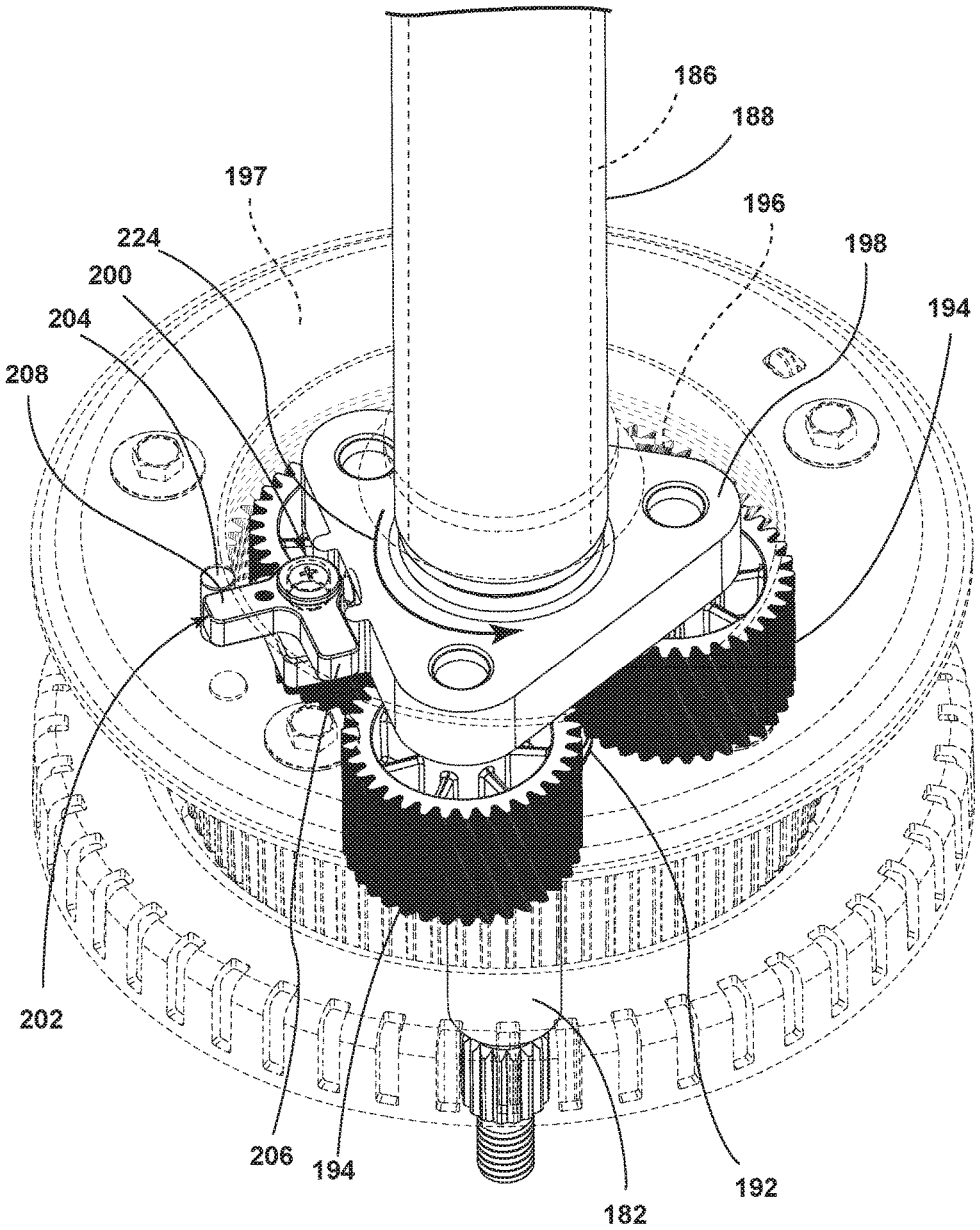

For example, in FIG. 5A a first leg 206 of the tang clutch 202 abuts the clutch pin 204. When the planet carrier 198 along with the clothes mover 38 and the clutch pin 204 both of which move therewith are rotated in a counter-clockwise direction as illustrated by the arrow 220 then the clutch pin 204 comes into contact with the tang clutch 202 as illustrated. As illustrated in FIG. 5B, continued rotational movement of the clothes mover 38 in the counter-clockwise direction, as illustrated by arrow 222, will pivot the tang clutch 202 such that the first leg 206 is moved inwardly towards the carrier plate 198 and the second leg 208 is moved radially outward. Continued rotational movement of the clothes mover 38 in the counter-clockwise direction brings the clutch pin 204 into contact with second leg 208 as illustrated in FIG. 5C. Any additional motion of the clothes mover 38 in the counter-clockwise direction, as illustrated by the arrow 224, results in coupling of the clothes mover 38 and the basket 30 such that they will rotate together. Thus, the tang clutch 202 is pivotal between first and second indexed positions to selectively couple and uncouple, respectively, the clothes mover 38 and the basket 30 and the movement of the tang clutch 202 between the first and second indexed positions.

It will be understood that the clutch mechanism 200 can be configured in alternative ways including the locations of the tang clutch and clutch pin. It will further be understood that the rotatable tang clutch can be any suitable shape, including an L-shape, a T-shape, or a clover-shape.

Figure 6A:
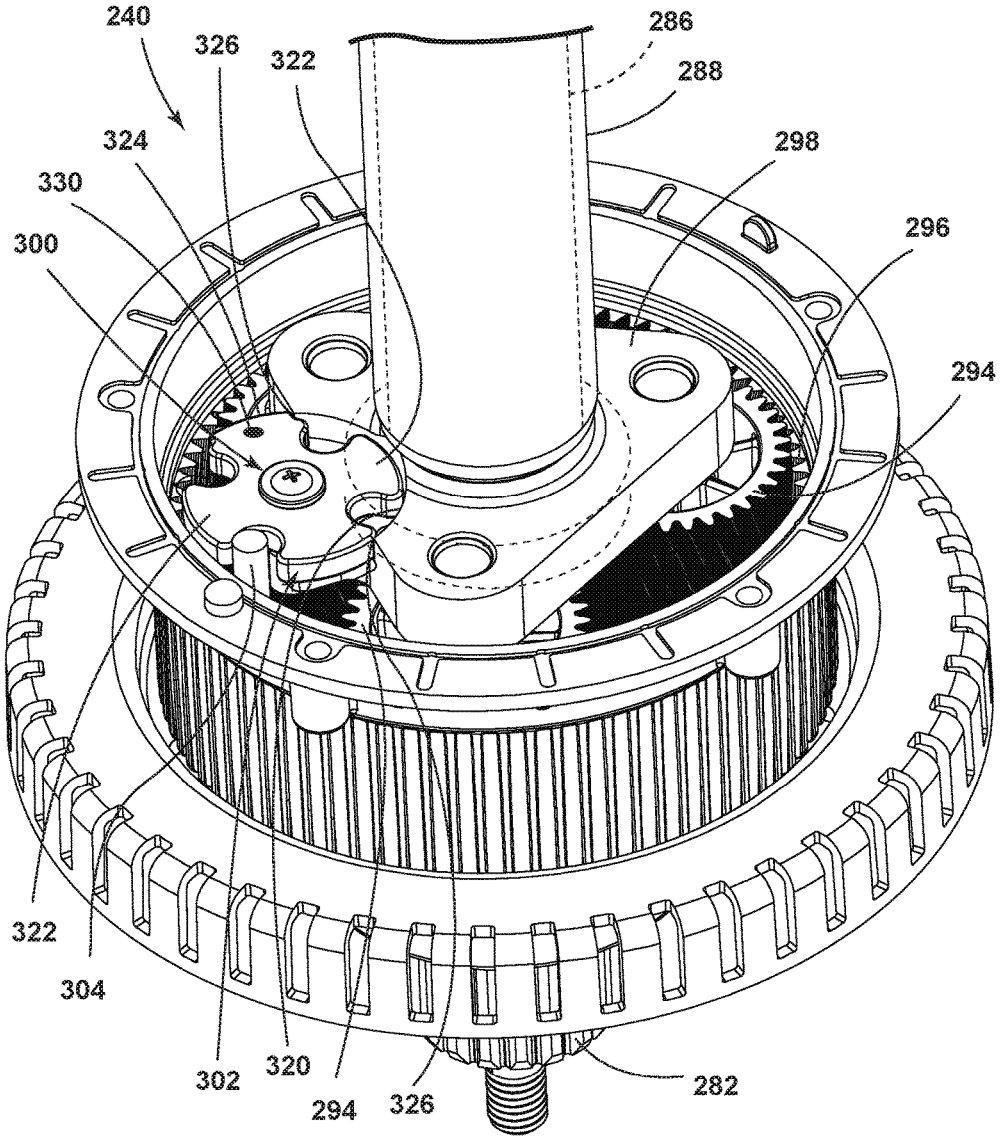
FIGS. 6A-6I illustrate a portion of another alternative drive system and loss motion device that can be included in the laundry treating appliance of FIG. 1 in accordance with the present disclosure.

Referring now to FIG. 6A, another embodiment includes a loss motion device or clutch mechanism 300 of a drive mechanism 240. The third embodiment is similar to the second embodiment; therefore, like parts will be identified with like numerals increased by 100, with it being understood that the description of the like parts of the second embodiment applies to the third embodiment, unless otherwise noted.

FIG. 6A illustrates a portion of the drive mechanism 240 with the plate connecting the ring gear 296 and the second drive shaft 288 removed for clarity. The rotatable tang clutch 302 is operably coupled to the planet carrier 298 and connected to move with the clothes mover 38. In the exemplary illustration the planet carrier 298 includes a recess 320 in which portions of the tang clutch 302 can be received. Another difference is that the tang clutch 302 is clover-shaped with a set of arms. The set of arms includes three arms 322, which can be received within or otherwise fit within the recess 320 of the planet carrier 298 and a fourth arm 324 that interfaces with interface portions 326 of the planet carrier 298.

As with the previously described embodiment, the clutch mechanism 300 includes a clutch pin 304 mounted on the ring gear 296 and the ring gear 296 is connected to move with the basket 30. Further, the clutch pin 304 is engageable with the tang clutch 302 at a predetermined angular position of the ring gear 296 relative to the planet carrier 98. The clover-shape of the tang clutch 302 results in the clothes mover 38 being able to oscillate over a greater range before the clothes mover 38 and basket 30 are coupled to spin together.

Figure 6B:
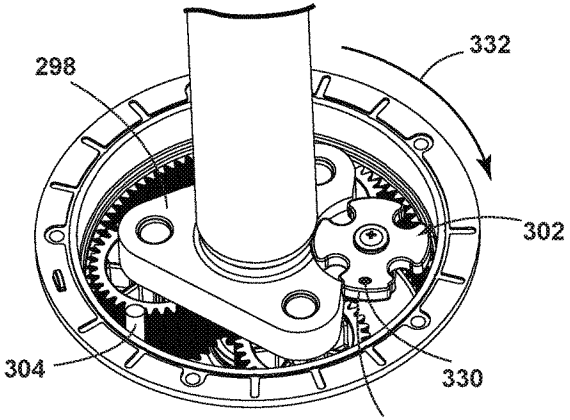
Figure 6C:
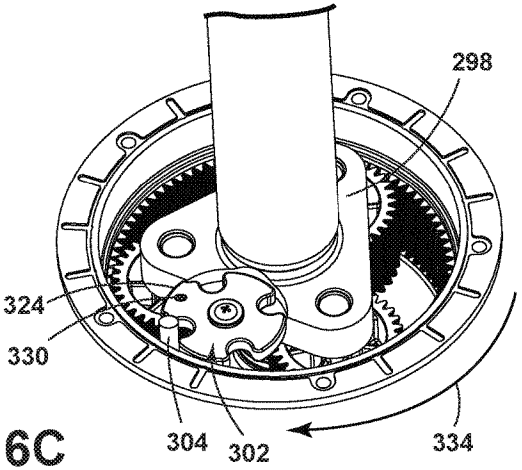
Figure 6D:
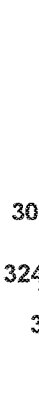

More specifically, during operation, the clothes mover 38 can engage in oscillatory motion of up to a 1080 degree stroke angle before the tang clutch 302 and the clutch pin 304 rotationally engage. FIG. 6A illustrates a starting position of the tang clutch 302 where the clutch mechanism 300 is locked in a counter-clockwise directions. The tang clutch 302 indexes every rotation of the planet carrier 298 due to contact with the clutch pin 304. A reference marker indicated as 330 has been included to provide a reference location for the explanation of movement of the tang clutch 302. FIG. 6B illustrates a first rotation of the planet carrier 298 in a clockwise direction as illustrated by arrow 332. FIG. 6C illustrates the continued rotation of the planet carrier 298 in a clockwise direction as illustrated by arrow 334 until the tang clutch 302 is engaged with the clutch pin 304. Further rotation of the planet carrier 298 in the clockwise direction causes the tang clutch 302 to pivot, rotate, or otherwise index. FIG. 6D illustrates that the tang clutch 302 has rotated to a new position (see reference marker 330) based on engagement with the clutch pin 304.

Figure 6E:
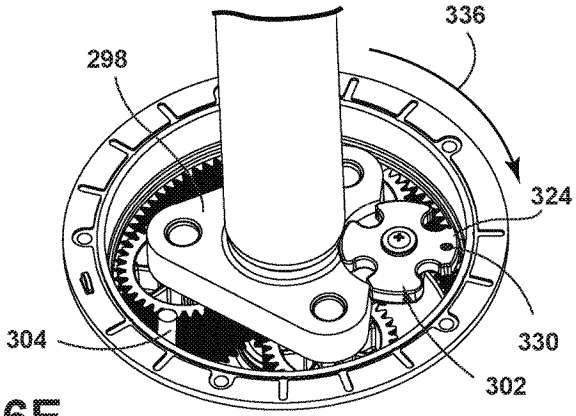
Figure 6G:
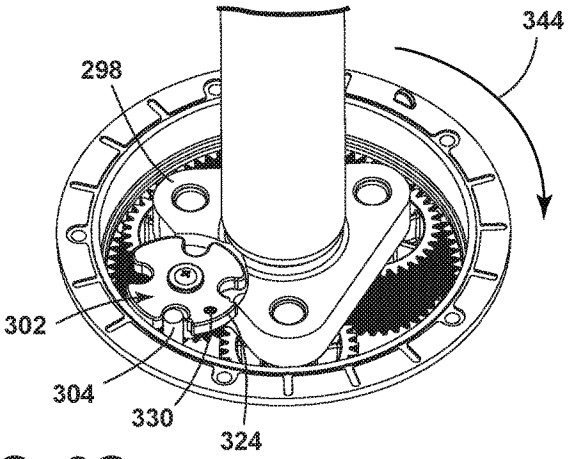
Figure 6I:
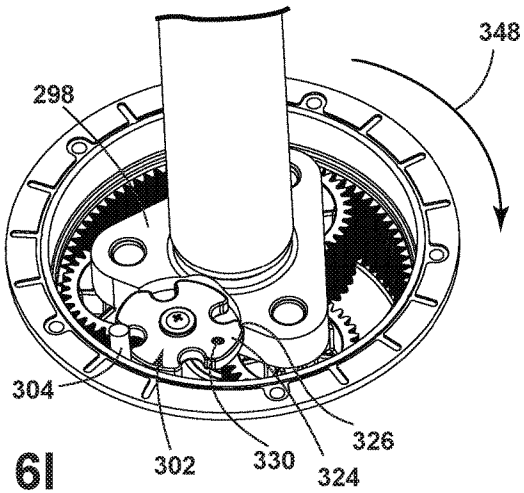
Figure 6F:
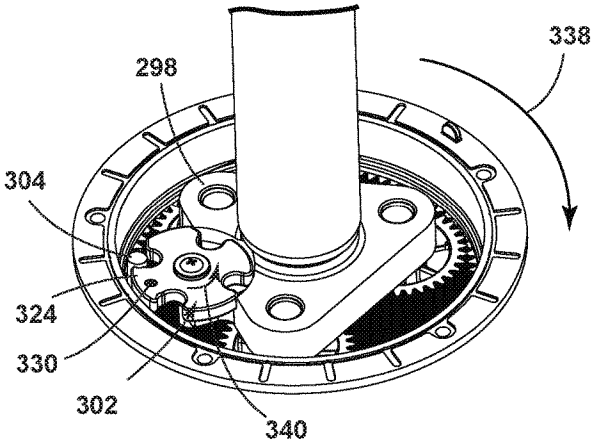

FIG. 6E illustrates a second rotation of the planet carrier 298 in a clockwise direction as illustrated by arrow 336. FIG. 6F illustrates the continued rotation of the planet carrier 298 in a clockwise direction as illustrated by arrow 338 until the tang clutch 302 is engaged with the clutch pin 304. FIG. 6G illustrates that the tang clutch 302 has rotated to a new position based on engagement with the clutch pin 304 (see arrow 340 and movement of reference marker 330).

Figure 6H:
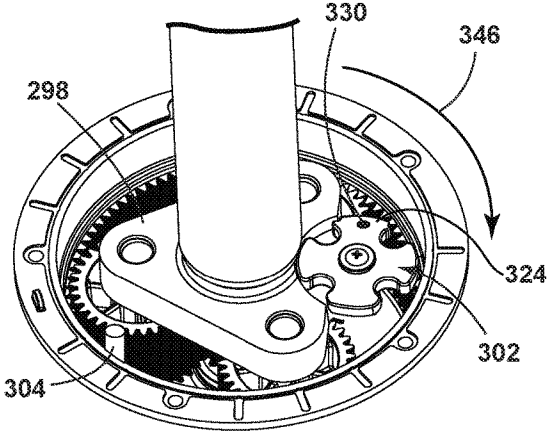

FIG. 6H illustrates a third rotation of the planet carrier 298 in a clockwise direction as illustrated by arrow 344. FIG. 6I illustrates the continued rotation of the planet carrier 298 in a clockwise direction as illustrated by arrow 346 until the tang clutch 302 is engaged with the clutch pin 304. FIG. 6I illustrates that the tang clutch 302 has engaged the planet carrier 298 at interface 326 and when the tang clutch 302 engages the pin 304 with continued rotation in the clockwise direction as illustrated by arrow 348, the tang clutch 302 can no longer index because of interference with the interface 326 and the tang clutch 302 and clutch pin 304 are locked. Further rotation of the drive shaft 282 and the planet carrier 298 in the clockwise direction will result in movement of the basket 30 in the clockwise direction.

In this manner, the tang clutch 302 indexes every rotation of the planet carrier 98 due to contact with the clutch pin 304, for up to three rotations. This enables up to 1080 degrees of rotation before rotational engagement of the clothes mover 38 and the basket 30. It will be understood that the exemplary movement described with respect to FIGS. 6A-6I is based on clockwise rotation but that the movement of the clothes mover 38 and the planet carrier 298 is reversible. In such an instance, when the clothes mover 38 is rotated in the opposite direction, the tang clutch 302 can move in an opposite manner until the tang clutch 302 and clutch pin 304 are locked in the counter-clockwise direction. Thus, the pin 304 engages the tang clutch 302 to move the tang clutch 302 through indexed positions with each full rotation of the clothes mover 38 until a position of engagement is reached and further rotary motion of the clothes mover 38 will cause engagement of the tang clutch 302 and the clutch pin 304 and resulting rotary motion of the perforated basket 30.

It will be understood that the loss motion device or clutch mechanism can be implemented in any suitable manner so long as the clutch mechanism provides a predetermined number of rotations before engagement of the clutch. The number of indexed positions of the clutch assembly correlates to the number of rotations before engagement of the clutch mechanism. Then, after the prescribed number of rotations or revolutions, the clothes mover and basket are coupled together. It should also be understood that that the rotation needed to move the clutch mechanism to a next indexed position need not be a full rotation. First, the movement needed to index the clutch mechanism can be less than a full rotation depending on where the pin is when the rotation begins. Further, there could be multiple pins located around the periphery, so that the tang clutch indexes multiple times per rotation.

In a traditional vertical axis laundry treating appliance, the drive system is a significant contributor to cost and complexity. For example, current appliances can include a synchronous motor to go from agitation to spin, which costs roughly four dollars and another fifty cents to interface with the drive system. The various aspects described herein removes the splined clutch components and shift actuator in favor of a simple loss motion device or tang clutch. This allows independent motion of the clothes mover for wash and then engagement of the clutch for extraction spin. Aspects of the present disclosure provide similar performance to contemporary appliances while reducing the transmission system and costs related thereto. Such a reduction can also result in a stack height reduction of the wash unit and the drive system along with maintained or increased capacity. Contemporary tang clutches previously used in the industry only allowed 180 degrees to 360 degrees of rotation before the basket was spun with the agitator.

To the extent not already described, the different features and structures of the various embodiments can be used in combination with each other as desired. That one feature may not be illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance, comprising:

a tub defining an interior;

a basket located within the interior and rotatably mounted within the tub;

a clothes mover rotatably mounted within the basket;

a motor drivingly coupled to the clothes mover to selectively oscillate or rotate the clothes mover; and a loss motion device having a rotatable clutch configured to rotate among a successive set of indexed positions and a clutch pin;

wherein the clutch pin moves the rotatable clutch through the successive set of indexed positions in response to successive rotations of the clothes mover until the rotatable clutch reaches a last of the indexed positions and engagement between the clutch pin and the rotatable clutch when the rotatable clutch occupies the last indexed position causes rotational coupling of the clothes mover and the basket.

2. The laundry treating appliance of claim 1 wherein the loss motion device is configured to enable oscillatory movement by the clothes mover by an amount up to 720 degrees prior to rotational coupling of the clothes mover and the basket.

3. The laundry treating appliance of claim 1 wherein the loss motion device is configured to enable oscillatory movement by the clothes mover by an amount up to 1080 degrees prior to rotational coupling of the clothes mover and the basket.

4. The laundry treating appliance of claim 1 wherein at least one of the rotatable clutch or the clutch pin includes a sound deadening material.

5. The laundry treating appliance of claim 1, further comprising:

a planetary drive mechanism having a sun gear;

a plurality of planet gears driven by the sun gear; and a planet carrier and a ring gear driven by the sun gear;

wherein the motor is operably connected to the sun gear, the clothes mover is operably connected to the planet carrier driven by the plurality of planet gears, and the basket is operably connected to the ring gear.

6. The laundry treating appliance of claim 5 wherein the rotatable clutch is rotatably mounted to the planet carrier and connected to move with the clothes mover, and the clutch pin is carried on the ring gear and connected to move with the basket.

7. The laundry treating appliance of claim 1 wherein the rotatable clutch is a rotatable tang clutch with an L-shape having two indexed positions.

8. The laundry treating appliance of claim 1 wherein the rotatable clutch is a rotatable tang clutch with a T-shape having three indexed positions.

9. The laundry treating appliance of claim 1 wherein the rotatable clutch is a rotatable tang clutch with a clover shape having three indexed positions.

10. The laundry treating appliance of claim 1 wherein the rotatable clutch is a rotatable tang clutch operably coupled to a base of the basket.

11. A laundry treating appliance, comprising:

a tub defining an interior;

a basket located within the interior and rotatably mounted within the tub;

a clothes mover rotatably mounted within the basket;

a motor drivingly coupled to the clothes mover to selectively oscillate or rotate the clothes mover; and a tang clutch assembly having a rotatable tang clutch operably coupled to one of the clothes mover or the basket and a clutch pin operably coupled to the other of the clothes mover or the basket;

wherein the tang clutch assembly is rotatable among a set of successive indexed positions; and wherein the clutch pin is configured to contact the tang clutch assembly to rotate the tang clutch assembly through the set of successive indexed positions in response to successive rotations of the clothes mover until the clutch reaches a last indexed position of the set of successive indexed positions and engagement between the clutch pin and the tang clutch when the tang clutch occupies the last indexed position causes rotational coupling of the clothes mover and the basket.

12. The laundry treating appliance of claim 11, wherein the tang clutch assembly moves from one indexed position to a next indexed position in response to the clothes mover completing a full rotation.

13. The laundry treating appliance of claim 11 wherein the rotatable tang clutch is L-shaped.

14. The laundry treating appliance of claim 11 wherein the rotatable tang clutch is operably coupled to the basket and the clutch pin is operably coupled to the clothes mover.

15. The laundry treating appliance of claim 11 wherein the tang clutch assembly permits oscillatory motion of the clothes mover having a stroke angle up to 720 degrees.

16. The laundry treating appliance of claim 11 wherein the tang clutch assembly permits oscillatory motion of the clothes mover having a stroke angle up to 1080 degrees.

17. A laundry treating appliance, comprising:

a tub defining an interior;

a basket located within the interior and rotatably mounted within the tub;

a clothes mover rotatably mounted within the basket;

a motor drivingly coupled to the clothes mover to selectively oscillate or rotate the clothes mover; and a planetary drive mechanism having:

a sun gear operably connected with the motor;

a plurality of planet gears;

a planet carrier connected to the plurality of planet gears and operably connected with the clothes mover; and a ring gear operably connected with the basket; and a tang clutch rotatably mounted on the planet carrier and configured to rotate among a set of indexed positions to permit oscillatory motion of the clothes mover and rotary motion of the clothes mover and the basket;

wherein the tang clutch permits oscillatory motion of the clothes mover by an amount greater than 360 degrees before the tang clutch occupies a last indexed position of the set of indexed positions and causes rotational coupling of the clothes mover and the basket.

18. The laundry treating appliance of claim 17 wherein the tang clutch permits oscillatory motion of the clothes mover having a stroke angle up to 1080 degrees.

19. The laundry treating appliance of claim 17, further comprising a clutch pin mounted on the ring gear and configured to move the tang clutch through the set of indexed positions in response to successive rotations of the clothes mover until the tang clutch reaches a last of the set of indexed positions and engagement between the clutch pin and the tang clutch when the tang clutch occupies the last of the set of indexed position causes rotational coupling of the clothes mover and the basket.

* * * * *